US010013993B2

(12) United States Patent
Liu et al.

(10) Patent No.: US 10,013,993 B2
(45) Date of Patent: Jul. 3, 2018

(54) APPARATUS AND METHOD FOR SURROUND AUDIO SIGNAL PROCESSING

(71) Applicant: Panasonic Corporation, Osaka (JP)

(72) Inventors: Zongxian Liu, Singapore (SG); Naoya Tanaka, Fukuoka (JP)

(73) Assignee: PANASONIC CORPORATION, Osaka (JP)

( * ) Notice: Subject to any disclaimer, the term of this patent is extended or adjusted under 35 U.S.C. 154(b) by 0 days.

(21) Appl. No.: 15/274,415

(22) Filed: Sep. 23, 2016

(65) Prior Publication Data

US 2017/0011750 A1 Jan. 12, 2017

Related U.S. Application Data

(63) Continuation of application No. PCT/JP2014/059700, filed on Mar. 26, 2014.

(51) Int. Cl.

| | |
|---|---|
| ***H04R 5/02*** | (2006.01) |
| ***G10L 19/16*** | (2013.01) |
| ***G10L 19/008*** | (2013.01) |
| ***H04S 3/00*** | (2006.01) |
| ***G10L 19/022*** | (2013.01) |

(52) U.S. Cl.

CPC ..... *G10L 19/167* (2013.01); *G10L 19/008* (2013.01); *G10L 19/022* (2013.01); *H04S 3/008* (2013.01); *H04S 2420/11* (2013.01)

(58) Field of Classification Search

USPC ..... 381/22, 23, 26, 57, 307, 308, 309, 310, 381/311

See application file for complete search history.

(56) References Cited

U.S. PATENT DOCUMENTS

2012/0155653 A1* 6/2012 Jax ..... G10L 19/008 381/22
2012/0243690 A1* 9/2012 Engdegard ..... G10L 19/008 381/22
2012/0259442 A1 10/2012 Jin et al.
2013/0010971 A1 1/2013 Batke et al.

(Continued)

FOREIGN PATENT DOCUMENTS

| | | |
|---|---|---|
| WO | 2008/046530 | 4/2008 |
| WO | 2010/013450 | 2/2010 |
| WO | 2013/171083 | 11/2013 |

OTHER PUBLICATIONS

V. Pulkki, "Virtual Sound Source Positioning Using Vector Base Amplitude Panning", J. Audio Eng. Soc., vol. 45, No. 6, Jun. 1997, pp. 456-466.

(Continued)

*Primary Examiner* — Yosef K Laekemariam

(74) *Attorney, Agent, or Firm* — Wenderoth, Lind & Ponack, L.L.P.

(57) ABSTRACT

An apparatus for decoding surround audio signal, includes a Bitstream De-multiplexer for unpacking a bitstream into spatial parameters and core parameters, a set of Core Decoder for decoding the core parameters into a set of core signal, a matrix derivation unit for deriving the rendering matrix from the spatial parameters and playback speaker layout information, a renderer for rendering of the decoded core signal to playback signals using the rendering matrix.

17 Claims, 14 Drawing Sheets

(56) References Cited

U.S. PATENT DOCUMENTS

2013/0132098 A1* 5/2013 Beack ..... H04S 7/30
704/500

OTHER PUBLICATIONS

T. Lossius et al., "DBAP—Distance-Based Amplitude Panning", International Computer Music Conference (ICMC), Montreal, 2009, pp. 1-4.
International Search Report (ISR) dated Aug. 26, 2014 in International (PCT) Application No. PCT/JP2014/059700.
International Preliminary Report on Patentability (IPROP) dated Jun. 8, 2016 in International (PCT) Application No. PCT/JP2014/059700.

* cited by examiner

APPARATUS AND METHOD FOR SURROUND AUDIO SIGNAL PROCESSING

CROSS-REFERENCE TO RELATED APPLICATIONS

This is a continuation application of International Application No. PCT/JP2014/059700, with an international filing date of Mar. 26, 2014, the content of which is incorporated herein by reference.

TECHNICAL FIELD

This invention relates to surround audio signal processing system, more particularly it relates to audio signal encoding and decoding which can be used in any digitized and compressed audio signal storage or transmission applications and rendering for audio play back applications.

BACKGROUND ART

When listen to music or watch a video with audio, it is desirable for the audience to have high degree of audio envelopment, so that they have better sensation of the audio/and video scene. The sense of audio envelopment includes immersive 3D audio and accurate audio localization. Immersive 3D audio means that the audio system is able to virtualize sound sources at any position in space. Accurate audio localization means that the audio system is able to locate the sound sources precisely align with the original audio scene, in terms of both direction and distance [1].

The sense of audio envelopment can be provided by a 3D audio system, which uses a large number of loudspeakers. The speakers might be surrounding the audience and be situated at high, mid and low vertical positions.

Three types of input signals and formats are commonly used in 3D audio system: channel-based input, object-based input and Higher-Order Ambisonics.

Channel-based input is commonly used in today's 2D and 3D audio signal production processes and media (e.g. 22.2, 9.1, 8.1, 7.1, 5.1 etc), where each produced audio signal channel is intended to directly drive a loudspeaker in a designated position.

For object-based input, each produced audio signal channel represents an audio source that is intended to be rendered at a designated spatial position, independent of the number and location of actually available loudspeakers.

For Higher-Order Ambisonics (HOA), each produced audio signal channel is part of an overall description of the entire sound scene, independent of the number and location of actually available loudspeakers.

Among the three formats, the HOA format is representation of audio scene it is possible to render the ambisonic signals to any playback setup, including the non-standard speaker layout.

In prior arts, such as the model for MPEG-H 3D audio standardization, for the HOA format, at the decoder side, the HOA signal is firstly reconstructed from decoded core signals and then rendered to the speaker setup.

FIG. 1 illustrates decoder in the model of MPEG-H 3D audio standardization, for the HOA format.

Firstly, the input bit stream is de-multiplexed (101) into N bit streams originally created by the AAC-family mono encoders plus the parameters required to recompose the full HOA representation from these bit streams.

In the multi-channel perceptual decoding component (102, 103 and 104), the N bit streams are individually decoded by AAC-family mono decoders to produce N signals.

In the successive spatial decoding component, first, the actual value range of these signals is reconstructed by the inverse gain control processing (105). In a next step, the N signals are re-distributed to provide the M pre-dominant signals and (N−M) HOA coefficient signals representing the more ambient HOA components (105).

The fixed subset of the (N−M) HOA coefficient signals is re-correlated, this means the decorrelation at the HOA encoding stage is reversed (107).

Next, all of the (N−M) HOA coefficient signals are used to create the ambient HOA components (107).

The predominant HOA components are synthesized from the M predominant signals and the corresponding parameters (106).

Finally, the predominant and the ambient HOA components are composed into the desired full HOA representation (108), which is then rendered to a given loudspeaker setup (109).

The detail process of the predominant sound synthesis, ambiance synthesis, HOA composition and rendering is explained as below.

In the Predominant Sound Synthesis (PSS) block (106), the HOA representation of the predominant sound component is computed from either of two methods. These methods are referred to as 'directional based' and 'vector based'.

In vector based PSS, the predominant sound is computed from the vector based signals. $X_{VEC}(k)$. The $X_{VEC}(k)$ signals represent time domain audio signals that have been decoupled from their spatial characteristics. The reconstructed HOA coefficients are computed by multiplying the vector based signals $X_{VEC}(k)$ with corresponding transformation vectors (represented by multiple vectors in $M_{VEC}(k)$). The $M_{VEC}(k)$ thus contain spatial characteristics (such as directionality and width) of the corresponding $X_{VEC}(k)$ time domain audio signals. The computation can be seen as below:

$$C_{VEC}(k)=(X_{VEC}(k)(\mathcal{M}_{VEC}(k))^T)^T \tag{1}$$

where

- $X_{VEC}(k)$ denotes the decoded vector based predominant sound
- $M_{VEC}(k)$ denotes the matrix to reconstruct the HOA coefficients from the vector based predominant sound
- $C_{VEC}(k)$ denotes the reconstructed HOA coefficients from the vector based predominant sound In directional based PSS, the HOA coefficients are computed from all direction based predominant sound signals $X_{PS}(k)$, using the tuple set $\mathcal{M}_{DIR}(k)$, the computation can be seen as below:

$$C_{DIR}k=(X_{PS}(k)(\mathcal{M}_{DIR}(k))^T)^T \tag{2}$$

where

- $X_{PS}(k)$ denotes the decoded direction based predominant sound
- $M_{DIR}(k)$ denotes the matrix to reconstruct the HOA coefficients from the direction based predominant sound
- $C_{DIR}(k)$ denotes the reconstructed HOA coefficients from the direction based predominant sound In Ambient Synthesis, the ambient HOA component frame $C_{AMB}(k)$ is obtained as below, according to reference [2]:

1) The first $O_{MIN}$ coefficients of the ambient HOA component are obtained by $$\begin{bmatrix} c_{AMB,1}(k) \\ c_{AMB,2}(k) \\ \vdots \\ c_{AMB,O_{MIN}}(k) \end{bmatrix} = \Psi_{MIN} \cdot \begin{bmatrix} c_{I,AMB,1}(k) \\ c_{I,AMB,2}(k) \\ \vdots \\ c_{I,AMB,O_{MIN}}(k) \end{bmatrix}, \quad (3)$$

Where $O_{MIN}$ denotes the minimum number of ambient HOA coefficients $\Psi_{MIN}$ denotes the mode matrix with respect to some fixed predefined directions $c_{I,AMB,n}$ (k) denotes the decoded ambient sound signal 2) The sample values of the remaining coefficients of the ambient HOA component are computed according to $$c_{AMB,n}(k) = \begin{cases} C_{I,AMB,n}(k) & \text{if } n \in \mathcal{J}_{AMB,ACT}(k) \setminus \{1, \ldots, O_{MIN}\} \\ 0 & \text{else} \end{cases} \quad (4)$$

Finally, in the HOA Composition the ambient HOA component and the predominant sound HOA component are superposed to provide the decoded HOA frame. If the prediction is not activated for the direction based predominant synthesis, the decoded HOA frame C(k) is computed by $$C(k)=C_{AMB}(k)+C_{DIR}(k) \text{ for direction based synthesis} \quad (5)$$

$$C(k)=C_{AMB}(k)+C_{VEC}(k) \text{ for vector based synthesis} \quad (6)$$

Where $C_{VEC}$ (k) denotes the reconstructed HOA coefficients from the vector based predominant sound $C_{DIR}$ (k) denotes the reconstructed HOA coefficients from the direction based predominant sound $C_{AMB}$ (k) denotes the reconstructed HOA coefficients from the ambient signal C (k) denotes the final reconstructed HOA coefficients If the near field compensation is not applied, the decoded HOA coefficients C(k) is converted to the representation of loudspeaker signals W(k) by multiplication with the rendering matrix D:

$$W(k)=DC(k). \quad (7)$$

where

C(k) denotes the final reconstructed HOA coefficients

W(k) denotes the loudspeaker signals

D denotes the rendering matrix

In order to calculate the complexity of the above process, the following notations are defined:

1) the order of HOA signal is $O_{HOA}$, then the number of HOA coefficients is $(O_{HOA}+1)^2$, 2) the number of play back speakers is L.

3) the total number of core signal channel is N 4) the number of predominant sound channels is M 5) the number of ambient sound channels is N−M The complexity for Predominant Sound Synthesis is $$COM_{PSS}=Fs*M*(O_{HOA}+1)^2 \quad (8)$$

where $COM_{PSS}$ denotes the complexity for predominant sound synthesis

M denotes the number of predominant sound channels $O_{HOA}$ denotes the order of HOA Fs denotes the sampling frequency The complexity for Rendering is $$COM_{RENDER}=Fs*L*(O_{HOA}+1)^2 \quad (9)$$

where $COM_{RENDER}$ denotes the complexity for rendering

L denotes the number play back speakers $O_{HOA}$ denotes the order of HOA

Fs denotes the sampling frequency

The number of HOA coefficients is very large in typical HOA formats, as example if $O_{HOA}$=4, then number of HOA coefficients is $(4+1)^2$=25.

And in order to have better sensation of the 3D audio, the number of playback channels is also very large, for example, 22.2 setup has in total of 24 speakers.

The sampling frequency for audio signal is normally at 44.1 kHz or 48 kHz.

As example, the complexity is estimated for the predominant sound synthesis and rendering for M=4, $O_{HOA}$=4, L=24 and Fs=48 kHz:

$$\begin{aligned} COM_{PSS} &= F_S * M * (O_{HOA}+1)^2 \\ &= 48\text{ k} * 4 * (4+1)^2 \\ &= 4.8\ MOPS \end{aligned}$$

$$\begin{aligned} COM_{RENDER} &= F_S * L * (O_{HOA}+1)^2 \\ &= 48\text{ k} * 24 * (4+1)^2 \\ &= 28.8\ MOPS \end{aligned}$$

From the example, it can be seen that both of the synthesis and rendering processes are very complex and it is desirable to reduce the complexity.

SUMMARY OF INVENTION

As shown in the HOA composition process (Equation 1&2), predominant sound synthesis is done according to:

$$C_{VEC}(k)=(X_{VEC}(k)(\mathcal{M}_{VEC}(k))^T)^T \text{ for vector based synthesis} \quad (1)$$

$$C_{DIR}(k)=(X_{PS}(k)(\mathcal{M}_{DIR}(k))^T)^T \text{ for direction based synthesis} \quad (2)$$

Ambient sound synthesis is done according to:

$$\begin{bmatrix} c_{AMB,1}(k) \\ c_{AMB,2}(k) \\ \vdots \\ c_{AMB,O_{MIN}}(k) \end{bmatrix} = \Psi_{MIN} \cdot \begin{bmatrix} c_{I,AMB,1}(k) \\ c_{I,AMB,2}(k) \\ \vdots \\ c_{I,AMB,O_{MIN}}(k) \end{bmatrix}, \quad (3)$$

Rendering is done according to (Equation 7):

$$W(k)=DC(k) \quad (7)$$

The HOA composition and rendering process can be combined to one process of channel conversion*:

$$\begin{aligned} W(k) &= DC(k) \\ &= D(M_{VEC}(k)X_{VEC}(k) + \Psi_{MIN}X_{AMB}(k)) \\ &= DM_{VEC}(k)X_{VEC}(k) + D\Psi_{MIN}X_{AMB}(k) \end{aligned} \quad (10)$$

for vector based synthesis

-continued $$\begin{aligned} W(k) &= DC(k) \\ &= D(M_{DIR}(k)X_{PS}(k) + \Psi_{MIN}X_{AMB}(k)) \\ &= DM_{DIR}(k)X_{PS}(k) + D\Psi_{MIN}X_{AMB}(k) \\ &= (DM_{DIR}(k))X_{PS}(k) + D\Psi_{MIN}X_{AMB}(k) \end{aligned} \tag{11}$$

for direction based synthesis

As example, the complexity is estimated for the predominant sound synthesis and rendering for $O_{HOA}$=4, M=4, N=8, L=24 and Fs=48 kHz:

$$\begin{aligned} COM_{PSS+RENDER} &= FS*M*L + Fs*(N-M)*L \\ &= 48\ k*4*24 + 48\ k*4*24 \\ &= 9.216\ MOPS \end{aligned}$$

It can be seen from the above example, by implementing the invented idea, the complexity can be greatly reduced.

In the MPEG-H 3D Audio model, there is prediction component for some of the input sequences, and near field compensation before rendering for some conditions. This invention is not applied to the conditions when prediction component exists or near field compensation is performed.

In the MPEG-H 3D Audio model, in order to avoid artefacts due to changes of the directions (for direction based synthesis) between successive frames, the computation of the HOA representation from the directional signals is based on the concept of overlap add.

Hence, the HOA representation $C_{DIR}(k)$ of active directional signals is computed as the sum of a faded out component and a faded in component:

$$\begin{aligned} C_{DIR}(k) &= C_{DIR,OUT}(k-1) + C_{DIR,IN}(k) \\ &= M_{DIR}(k-1)X_{PS}(k-1)w_{out} + M_{DIR}(k)X_{PS}(k)w_{in} \end{aligned} \tag{12}$$

Which brings problem for the invented method as the fading in and fading out is done in HOA domain. To solve this problem, the following ideas are conceived:

1) Define $X'_{PS}(k-1)=X_{PS}(k-1)w_{out}$; $X'_{PS}(k)=X_{PS}(k)w_{in}$

2) Revise Equation 11 to:

$$\begin{aligned} W(k) &= DC(k) \\ &= D(C_{DIR,OUT}(k-1) + C_{DIR,IN}(k) + \Psi_{MIN}X_{AMB}(k)) \\ &= D(M_{DIR}(k-1)X_{PS}(k-1)w_{out} + M_{DIR}(k)X_{PS}(k)w_{in} + \\ &\quad \Psi_{MIN}X_{AMB}(k)) \\ &= DM_{DIR}(k-1)X'_{PS}(k-1) + DM_{DIR}(k)X'_{PS}(k) + \\ &\quad D\Psi_{MIN}X_{AMB}(k) \\ &= (DM_{DIR}(k-1))X'_{PS}(k-1) + (DM_{DIR}(k))X'_{PS}(k) + \\ &\quad D\Psi_{MIN}X_{AMB}(k) \end{aligned} \tag{13}$$

The above principle can be applied to the vector based synthesis if the fading in and fading out is done in the HOA domain for vector based synthesis.

If the fading in and fading out is done in vector domain for vector based synthesis, 1) Define $X'_{VEC}(k)=w_{out}X_{VEC}(k-1)+w_{in}X_{VEC}(k)$ 2) equation 10 is revised to:

$$\begin{aligned} W(k) &= DC(k) \\ &= D(M_{VEC}(k)(w_{out}X_{VEC}(k-1) + w_{in}X_{VEC}(k)) + \Psi_{MIN}X_{AMB}(k)) \\ &= DM_{VEC}(k)X'_{VEC}(k) + D\Psi_{MIN}X_{AMB}(k) \end{aligned} \tag{14}$$

DESCRIPTION OF EMBODIMENTS

The following embodiments are merely illustrative for the principles of various inventive steps. It's understood that variations of the details described herein will be apparent to others skilled in the art. Those who are skilled in the art will be able to modify and adapt this invention without deviating from the spirit of the invention.

1. First Embodiment

As the first embodiment of this invention, the invented surround sound decoder comprises a bitstream De-multiplexer for unpacking a bitstream into spatial parameters and core parameters; a set of Core Decoder for decoding the core parameters into a set of core signal; a matrix derivation unit for deriving the rendering matrix from the spatial parameters and the layout of the playback speakers; a renderer for rendering of the decoded core signal to playback signals using the rendering matrix.

Figure 1:
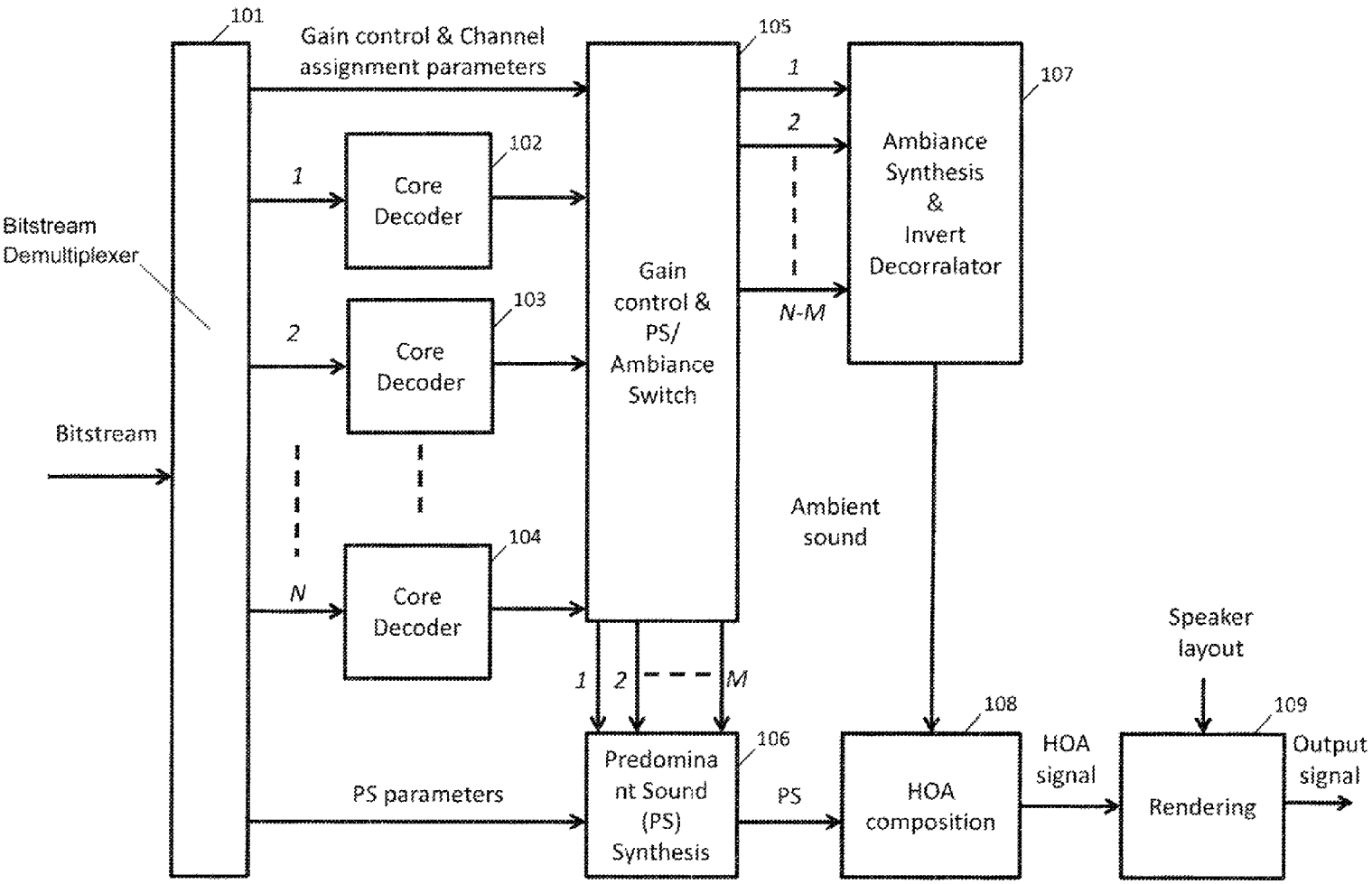
FIG. 1 is a decoder diagram of MPEG-H 3D audio standard of HOA input.
Figure 2:
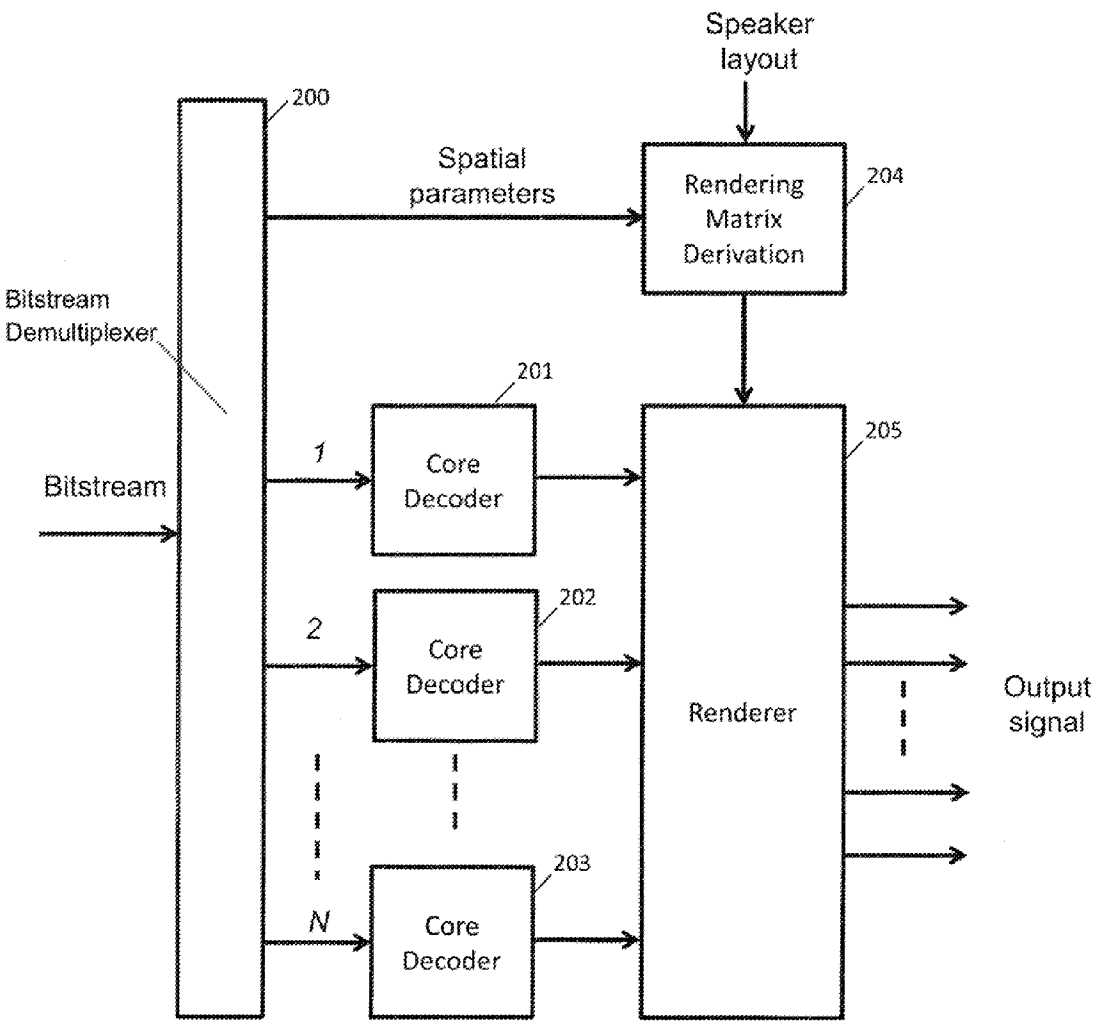
FIG. 2 is a decoder diagram of embodiment 1 in this invention.

FIG. 2 illustrates the afore-mentioned decoder of the first embodiment.

The bitstream de-multiplexer (200) unpacks the bitstream into spatial parameters and core parameters;

A set of core decoder (201, 202, 203) decode the core parameters into a set of core signal, the decoder can be any existing or new audio codec such as: MPEG-1 Audio Layer III or AAC or HE-AAC or Dolby AC-3 or MPEG USAC standard.

A matrix derivation unit (204) computes the rendering matrix from the spatial parameters and the layout of the playback speakers. The rendering may be derived using part of or all of the following parameters: number of target speaker (5.1, 7.1, 10.1 or 22.2 . . . ), the speakers' positions (distance from the sweet spot, horizontal angle and elevation angle), positions of a spherical modelling (horizontal and elevation angle), HOA order ($1^{st}$ order (4 HOA coefficients), $2^{nd}$ order (9 HOA coefficients) or $3^{rd}$ order (16 HOA coefficients) . . . ) and HOA decomposition parameters (direction based decomposition or PCA or SVD).

There are technologies available to derive the rendering matrix from the reconstructed input signal to desired speaker layout, such as VBAP (Vector based amplitude panning) [3] or DBAP (Direction based amplitude panning) [4] or the method described in released reference model for MPEG-H 3D audio for HOA format[2].

As example, if the input signal is $4^{th}$ order HOA, it has 25 HOA coefficients to cover 25 directions of the spherical space, the play back speaker set up is standard 22.2 channel set up. The rendering matrix maps 25 HOA coefficients to the 24 speaker channels.

If VBAP is used to derive the rendering matrix, VBAP uses a set of 24 unit vectors $l_1 \ldots l_{24}$ which point at the loudspeakers of the 22.2 speaker setup and a mesh of triangles are formed between the loudspeakers. For each of the 25 HOA spherical directions p, it is in one of the triangles formed by the speakers. The three speakers which forms the triangle are chosen to be the active speakers, the spherical direction p can be calculated by a linear combination of those loudspeaker vectors, $$p=[l_{n1},l_{n2},l_{n3}][g_1, \ldots ,g_{24}]^T \tag{15}$$

Where p denotes the HOA spherical direction.

$l_n$ denotes the loudspeaker vector $g_n$ denotes the scaling factor that is applied to $l_n$ $\{n_1, n_2, n_3\}$ denotes the active loudspeaker triplet In $\mathbb{R}_3$, a vector space is formed by 3 vector bases. This leads to the solution $$[g_{n1},g_{n2},g_{n3}]^T=[l_{n1},l_{n2},l_{n3}]^{-1}p \tag{16}$$

Where p denotes the HOA spherical direction.

$l_n$ denotes the loudspeaker vector $g_n$ denotes the scaling factor that is applied to $l_n$ $\{n_1, n_2, n_3\}$ denotes the active loudspeaker triplet The above procedure repeats for all of the 25 HOA spherical directions, all the gain parameters for each spherical directions can be derived and form the rendering matrix D.

The rendering from HOA coefficients to loudspeaker output can be explained in the equation below:

$$W(k)=DC'(k) \tag{17}$$

where

C'(k) denotes the fully reconstructed HOA coefficients

W (k) denotes the loudspeaker signals

D denotes the rendering matrix

However, in this invention, the fully reconstructed HOA coefficients are not available. Suppose that reconstructed HOA coefficients can be derived according to the equation below:

$$C'(k)=M^{-1}S'(k) \tag{18}$$

where

C'(k) denotes the fully reconstructed HOA coefficients

S'(k) denotes the decoded signal

M denotes the transformation matrix

By combing the equation (17) and equation (18), $$\begin{aligned} W(k) &= DC'(k) \\ &= D(M^{-1}S'(k)) \\ &= (DM^{-1})S'(k) \\ &= D'S'(k) \end{aligned} \tag{19}$$

$$D' = DM^{-1}$$

where

C'(k) denotes the fully reconstructed HOA coefficients

W(k) denotes the loudspeaker signals

D denotes the rendering matrix

M denotes the transformation matrix

D' denotes the new rendering matrix

Besides the above approach, it is possible to derive the rendering matrix directly using the decoded core signal and the speaker layout information.

Above procedures and equations are given as examples on how to implement the invention, those who are skilled in the art will be able to modify and adapt this invention without deviating from the spirit of the invention.

Finally, the renderer (205) renders the decoded core signal to playback signals using the rendering matrix.

Effect: In this embodiment, the surround audio signals are reconstructed and rendered to the desired speaker layout in one single step, which improves the efficiency and greatly reduces the complexity.

2. Second Embodiment

Figure 3:
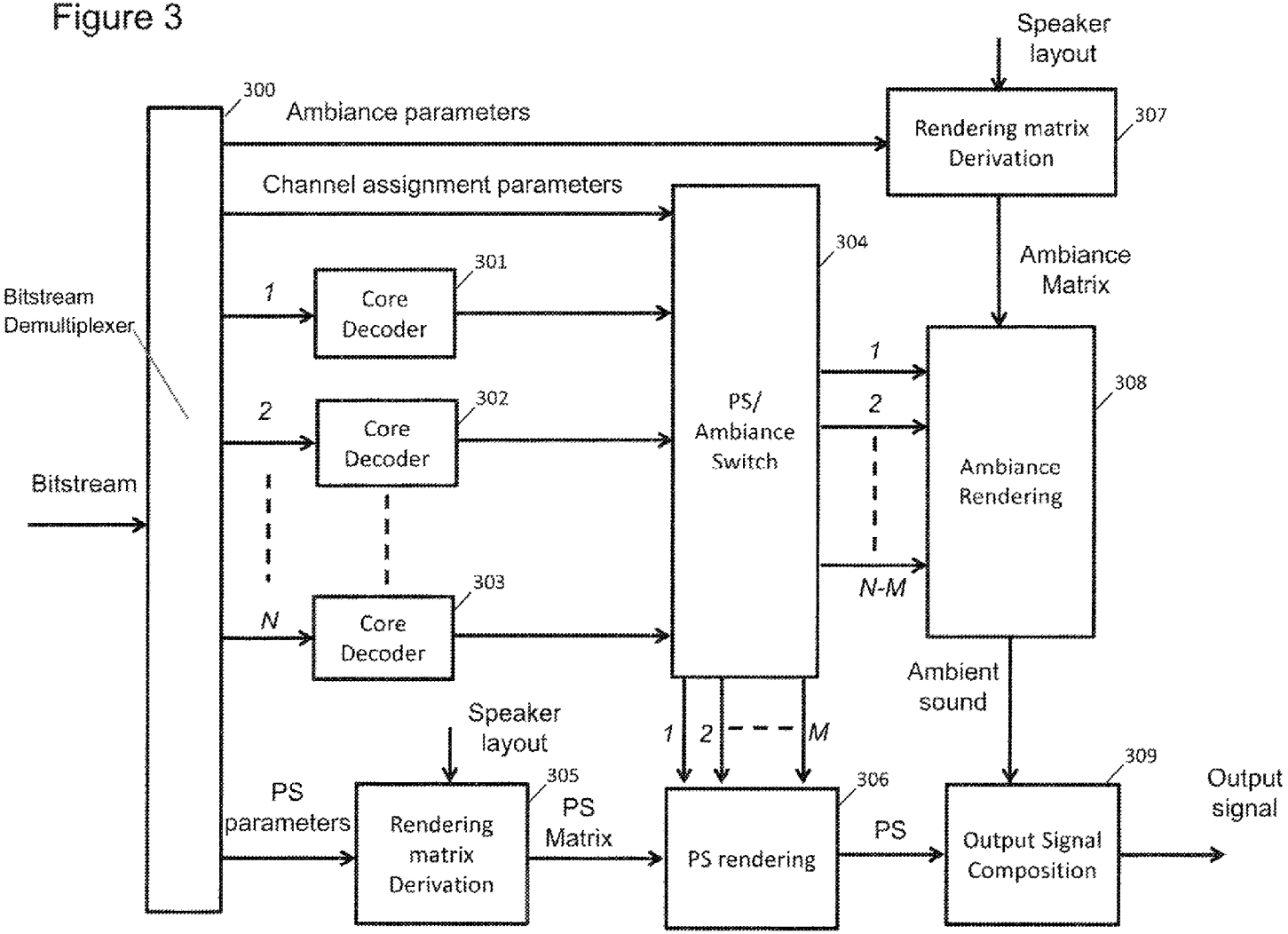
FIG. 3 is a decoder diagram of embodiment 2 in this invention.

The invented surround sound decoder comprises a bitstream de-multiplexer for unpacking a bitstream into predominant sound parameters, ambiance parameters, channel assignment parameters and core parameters; a set of Core Decoder for decoding the core parameters into a set of core signal; a predominant sound ambiance switch for assigning the decoded core signal to predominant sound and ambiance according to the channel assignment parameters; a matrix derivation unit for deriving the predominant sound rendering matrix from the predominant sound parameters and the layout of the playback speakers; a matrix derivation unit for deriving the ambiance rendering matrix from the ambiance parameters and the layout of the playback speakers; a predominant sound renderer for rendering of the predominant sound to playback signals using the rendering matrix; a ambiance renderer for rendering of the ambiance to playback signals using the rendering matrix; a output signal composition unit for composing the playback signals using the rendered predominant sound and ambient sound;

FIG. 3 illustrates the afore-mentioned decoder of the second embodiment.

The bitstream de-multiplexer (300) unpacks the bitstream into predominant sound parameters, ambiance parameters, channel assignment parameters and core parameters;

A set of core decoder (301, 302 and 303) decode the core parameters into a set of core signal, the decoder can be any existing or new audio codec such as: MPEG-1 Audio Layer III or AAC or HE-AAC or Dolby AC-3 or MPEG USAC standard.

The predominant sound/ambiance (304) switch assigns the decoded core signal to predominant sound or ambiance according to the channel assignment parameters.

A rendering matrix computation unit (305) computes the rendering matrix from the predominant sound parameters and the layout of the playback speakers. The detail derivation is skipped in this embodiment and supposes that the rendering matrix derived for the predominant sound is D'.

The predominant sound renderer (306) converts the decoded predominant sound to playback signals using the PS rendering matrix.

$$W_{PS}(k)=D'C_{PS}(k) \tag{20}$$

where $W_{PS}(k)$ denotes playback signal derived from the predominant sound $C_{PS}(k)$ denotes the decoded predominant sound signal D' denotes the PS rendering matrix A rendering matrix computation unit (307) computes the rendering matrix from the ambiance parameters and the layout of the playback speakers. The detail derivation is skipped in this embodiment and supposes that the rendering matrix derived for the ambient sound is $D_{AMB}$.

If the ambient sound was transformed to some other formats or processed in other ways before encoding, before rendering, the signals may be post processed to reconstruct the original ambient sound.

The ambiance renderer (308) converts the decoded ambient sound to playback signals using the ambiance rendering matrix.

$$W_{AMB}(k)=D_{AMB}C_{AMB}(k) \tag{21}$$

where $W_{AMB}(k)$ denotes playback signal derived from the ambient sound $C_{AMB}$ (k) denotes the decoded ambient sound signal $D_{AMB}$ denotes the ambiance rendering matrix The output signal composition unit composes the playback signals using the rendered predominant sound and ambient sound.

$$W(k)=W_{PS}(k)W_{AMB}(k) \tag{22}$$

where $W_{AMB}$ (k) denotes playback signal derived from the ambient sound $W_{PS}(k)$ denotes playback signal derived from the predominant sound W(k) denotes the final playback signals.

Effect: In this embodiment, the predominant sound signals are reconstructed and rendered to the desired speaker layout in one single step, which improves the efficiency and greatly reduces the complexity.

3. Third Embodiment

The invented surround sound decoder comprises a Bitstream De-multiplexer for unpacking a bitstream into spatial parameters and core parameters; a set of Core Decoder for decoding the core parameters into a set of core signal; a matrix derivation unit for deriving the rendering matrix from the spatial parameters and the layout of the playback speakers; a windowing unit for performing windowing on the previous frame and current frame decoded core signal; a summation unit for summing the windowed previous frame decoded core signal and windowed current frame decoded core signal to derived the smoothed core signal; a renderer for rendering of the smoothed core signal to playback signals using the rendering matrix;

In order to avoid artefacts across frame boundaries, it is common to apply windowing in audio signal processing.

Figure 4:
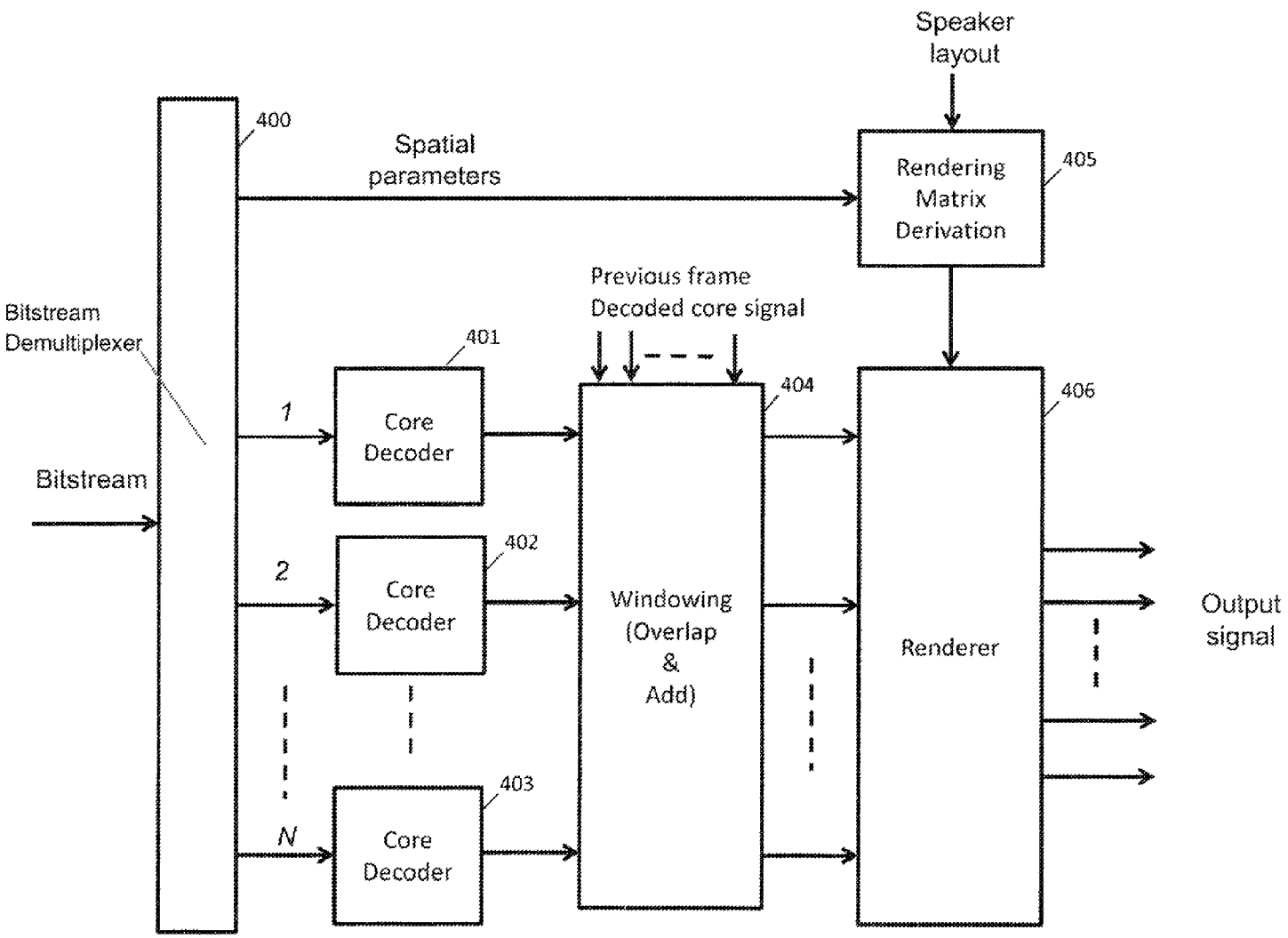
FIG. 4 is a decoder diagram of embodiment 3 in this invention.

As shown in FIG. 4, windowing is applied to the decoded core signal (404), equation (17) and equation (18) would be revised as:

$$C'(k)=M^{-1}(\mathrm{win}_{cur}S'(k)+\mathrm{win}_{pre}S'(k-1)) \tag{23}$$

where

C'(k) denotes the fully reconstructed HOA coefficients

S'(k) denotes the decoded signal for current frame

S'(k−1) denotes the decoded signal for previous frame $\mathrm{win}_{cur}$ denotes the windowing function for current frame $\mathrm{win}_{pre}$ denotes the windowing function for previous frame M denotes the transformation matrix $$W(k)=D'(\mathrm{win}_{cur}S'(k)+\mathrm{win}_{pre}S'(k-1)) \tag{24}$$

where

S'(k) denotes the decoded signal for current frame

S'(k−1) denotes the decoded signal for previous frame $\mathrm{win}_{cur}$ denotes the windowing function for current frame $\mathrm{win}_{pre}$ denotes the windowing function for previous frame W(k) denotes the loudspeaker signals D' denotes the new rendering matrix Effect: In this embodiment, windowing is applied to avoid artefacts across frame boundaries.

4. Fourth Embodiment

The invented surround sound decoder comprises: a Bitstream De-multiplexer for unpacking a bitstream into predominant sound parameters, ambiance parameters, channel assignment parameters and core parameters; a set of Core Decoder for decoding the core parameters into a set of core signal; a predominant sound ambiance switch for assigning the decoded core signal to predominant sound and ambiance according to the channel assignment parameters; a matrix derivation unit for deriving the predominant sound rendering matrix from the predominant sound parameters and the layout of the playback speakers; a matrix derivation unit for deriving the ambiance rendering matrix from the ambiance parameters and the layout of the playback speakers; a windowing unit for performing windowing on the previous frame and current frame predominant sound signal; a summation unit for summing the windowed previous frame predominant sound signal and windowed current frame predominant sound signal to derived the smoothed predominant sound signal; a predominant sound renderer for rendering of the smoothed predominant sound to playback signals using the rendering matrix; a ambiance renderer for rendering of the ambiance to playback signals using the rendering matrix; a output signal composition unit for composing the playback signals using the rendered predominant sound and ambient sound.

Figure 5:
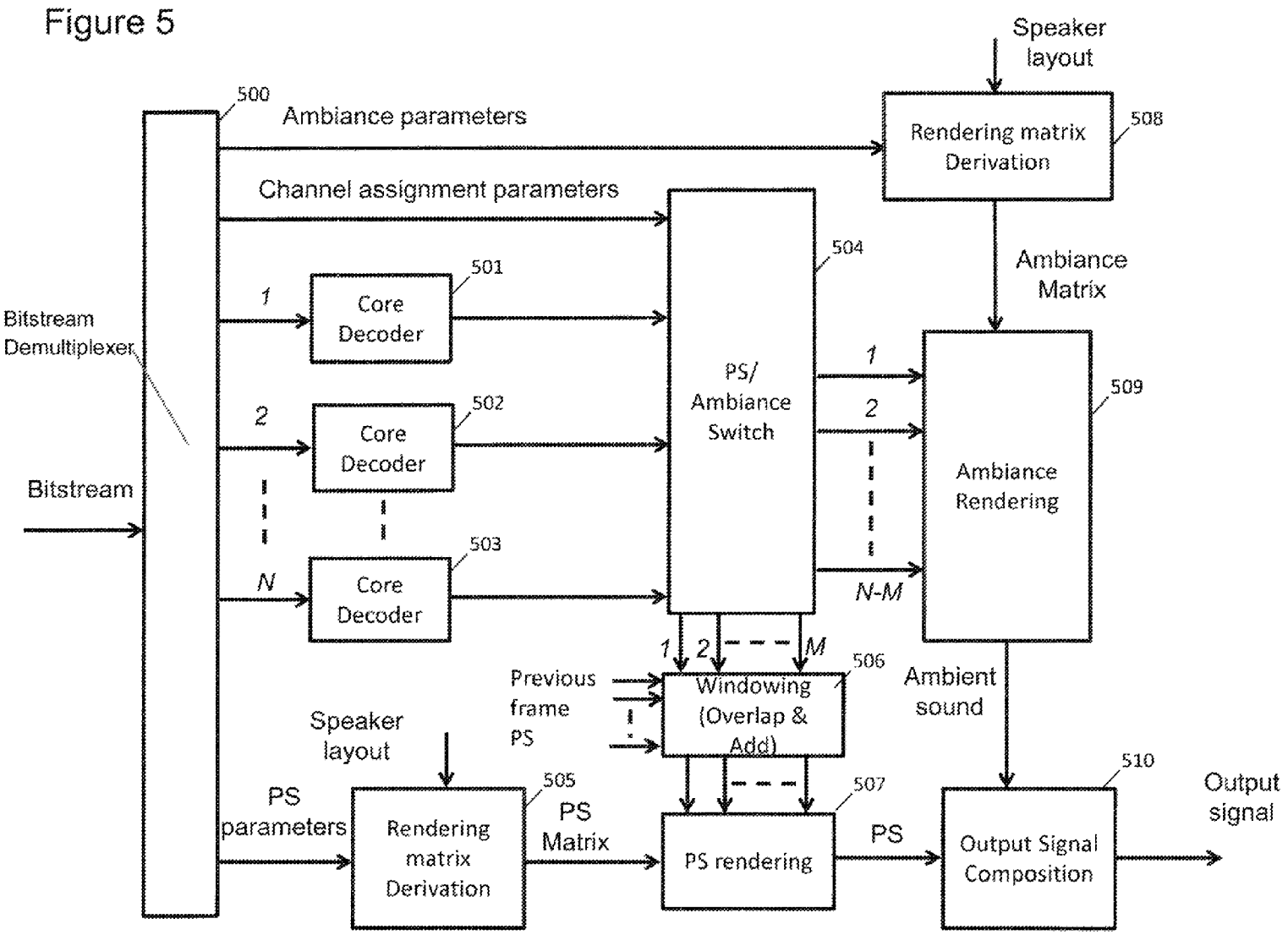
FIG. 5 is a decoder diagram of embodiment 4 in this invention.

As shown in FIG. 5, in order to ensure a continuous and smooth evolution of the sound field across the frame boundaries, windowing is applied to the predominant sound (506). Because windowing is applied to the predominant sound, equation (20) would be revised as:

$$W_{PS}(k)=D'(\mathrm{win}_{cur}C_{PS}(k)\mathrm{win}_{pre}C_{PS}(k-1)) \tag{25}$$

where $W_{PS}(k)$ denotes playback signal derived from the predominant sound $C_{PS}(k)$ denotes the decoded predominant sound signal for current frame $C_{PS}(k-1)$ denotes the decoded predominant sound signal for previous frame D' denotes the PS rendering matrix Effect: In this embodiment, windowing is applied to ensure a continuous and smooth evolution of the sound field across the frame boundaries.

5. Fifth Embodiment

Figure 6A:
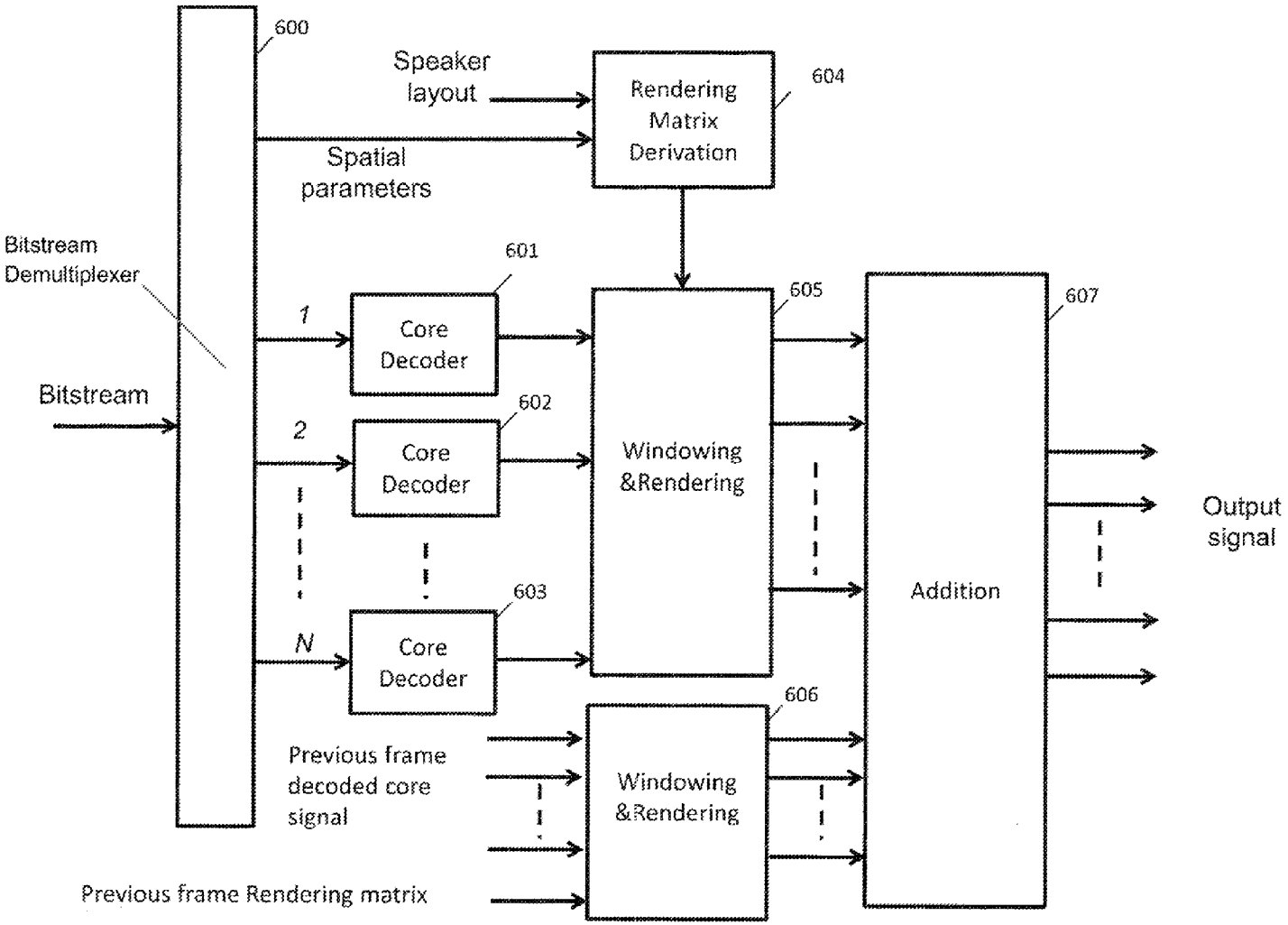
FIG. 6A is one decoder diagram of embodiment 5 in this invention.

As shown in FIG. 6A, the invented surround sound decoder comprises a Bitstream De-multiplexer (600) for unpacking a bitstream into spatial parameters and core parameters; a set of Core Decoder (601, 602 and 603) for decoding the core parameters into a set of core signal; a matrix derivation unit (604) for deriving the rendering matrix for current frame decoded signal from the spatial parameters and the layout of the playback speakers; a windowing and rendering unit (605) for performing windowing and rendering on the current frame decoded core signal using the rendering matrix; a windowing and rendering unit (606) for performing windowing and rendering on the previous frame decoded core signal using the rendering matrix; an addition unit (607) for adding the previous frame playback signal and current frame playback signal to form the final play back signal.

In order to avoid artefacts across frame boundaries, it is common to apply windowing in audio signal processing.

Suppose that in embodiment 1, windowing cannot be applied to the decoded core signal, because the decoded core signals in previous frame and current frame have different spatial directions, the windowing has to be applied to the reconstructed HOA coefficients.

Then equation (17) would be revised as:

$$\begin{aligned} W(k) &= D(win_{cur}C'(k) + win_{pre}C'(k-1)) \\ &= D(win_{cur}M_{cur}^{-1}S'(k) + win_{pre}M_{pre}^{-1}S'(k-1)) \\ &= (DM_{cur}^{-1})(win_{cur}S'(k)) + (DM_{pre}^{-1})(win_{pre}S'(k-1)) \\ &= D'_{cur}S''(k) + D'_{pre}S''(k-1) \end{aligned} \tag{26}$$

where

S'(k) denotes the decoded core signal for current frame

S'(k−1) denotes the decoded core signal for previous frame

S"(k) denotes the windowed core signal for current frame

S"(k−1) denotes the windowed core signal for previous frame $win_{cur}$ denotes the windowing function for current frame $win_{pre}$ denotes the windowing function for previous frame W(k) denotes the loudspeaker signals $D'_{cur}$ denotes the new rendering matrix for current frame $D'_{pre}$ denotes the new rendering matrix for previous frame C'(k) denotes the reconstructed audio signal for current frame C'(k−1) denotes the reconstructed audio signal for previous frame D denotes the rendering matrix $M_{cur}$ denotes the transformation matrix for current frame $M_{pre}$ denotes the transformation matrix for previous frame As shown in FIG. 6A, the windowing and rendering is firstly done on current frame decoded core signal and previous frame decoded core signal separately (605 and 606), then the previous frame rendered signal and current frame rendered signal is added together to form the final output (607).

For the windowing & rendering (606) for the previous frame decoded core signal, the previous frame rendering matrix can be retrieved from previous frame calculation if it is available/stored. If it is not available/stored, the rendering matrix can be computed following the same way as (604) but using previous frame spatial parameters and speaker layout information.

Figure 6B:
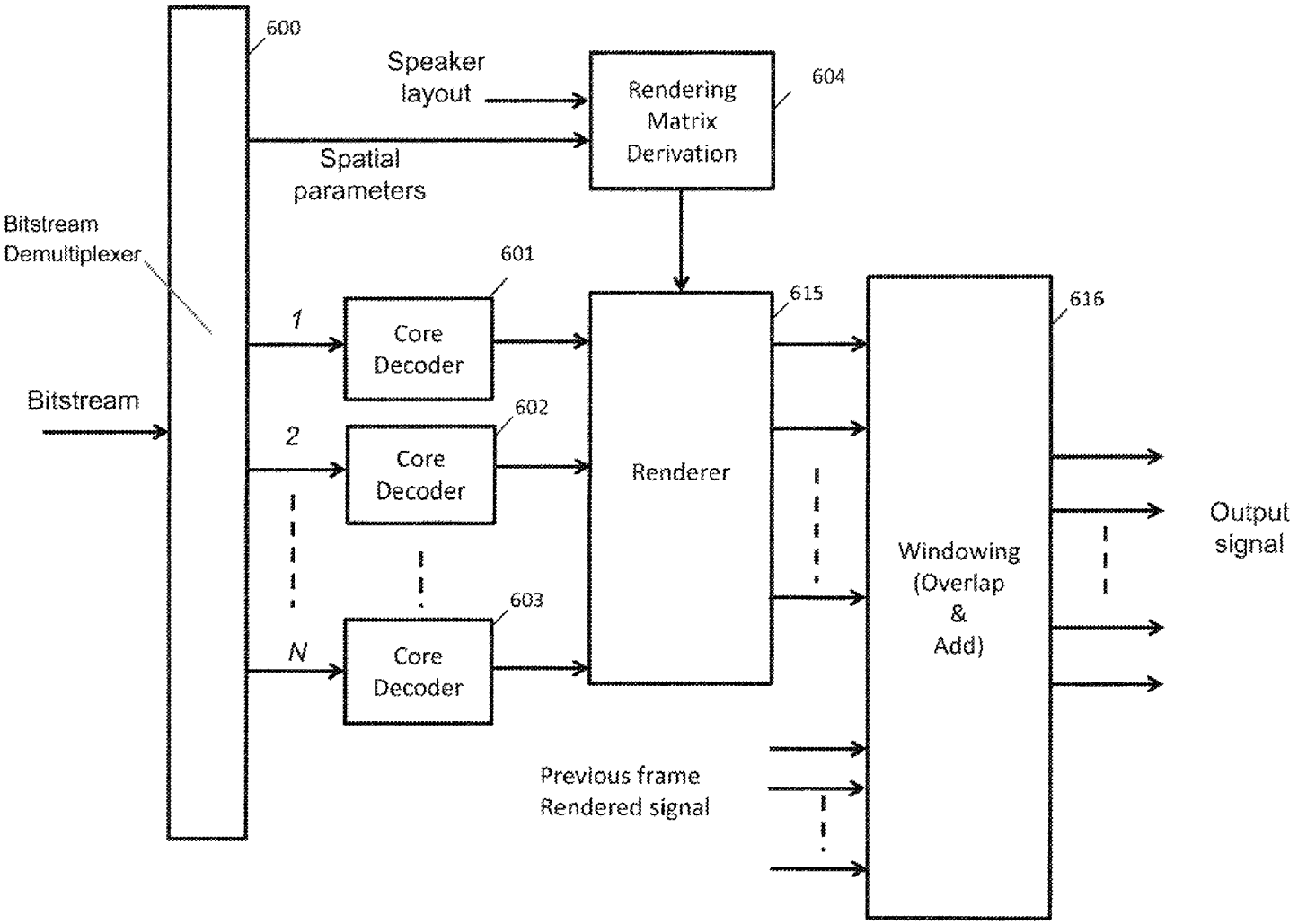
FIG. 6B is another decoder diagram of embodiment 5 in this invention.

Another method is shown in FIG. 6B, the rendering is firstly done on current frame decoded signal (615), then the windowing is done on the previous frame rendered signal and current frame rendered signal, finally the windowed previous frame rendered signal and current frame rendered signal is added together to form the final output (616).

Effect: In this embodiment, windowing is applied to avoid artefacts across frame boundaries.

6. Sixth Embodiment

Figure 7A:
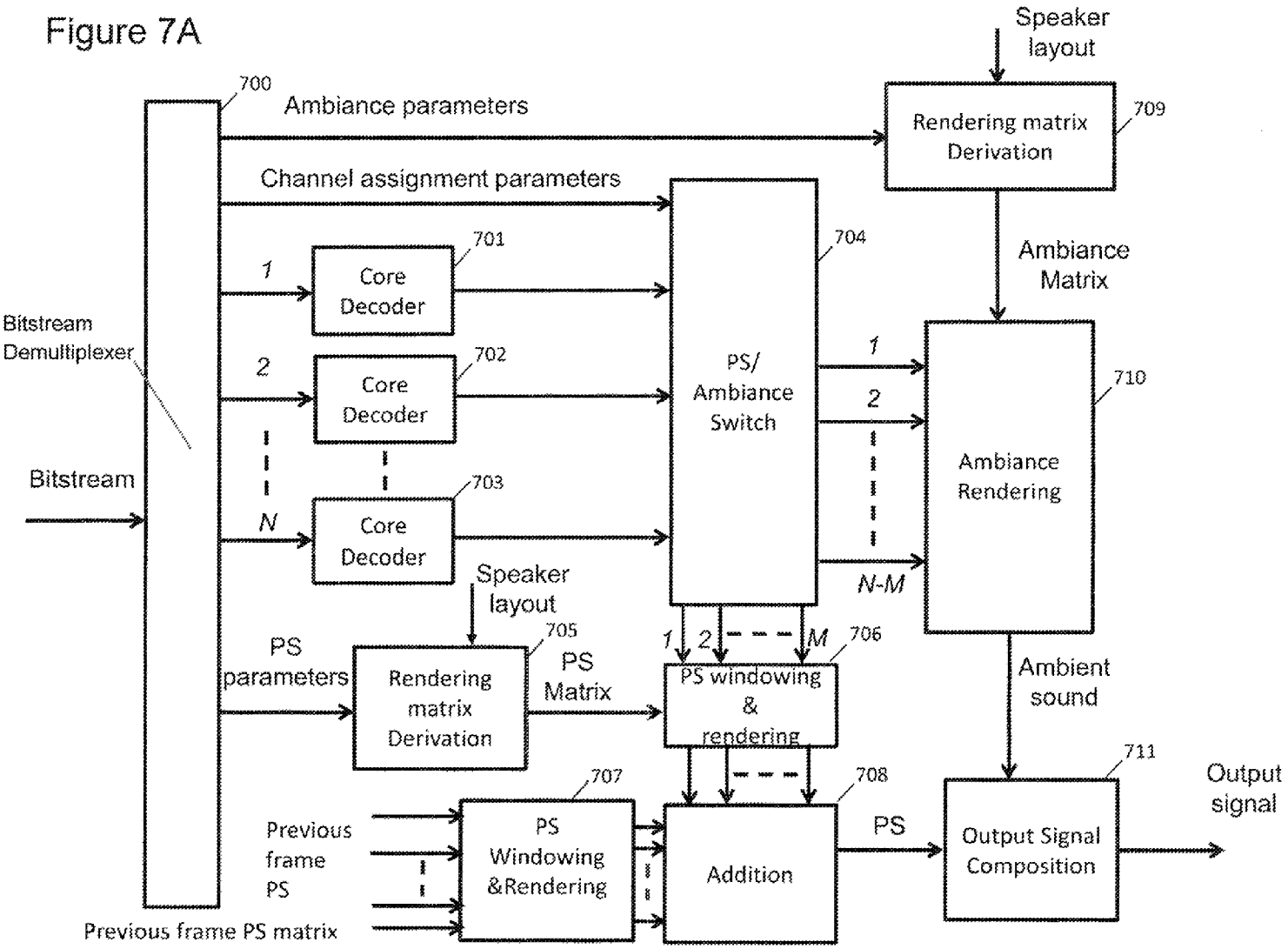
FIG. 7A is one decoder diagram of embodiment 6 in this invention.

As shown in FIG. 7A, the invented surround sound decoder comprises: a Bitstream De-multiplexer (700) for unpacking a bitstream into predominant sound parameters, ambiance parameters, channel assignment parameters and core parameters; a set of Core Decoder (701, 702 and 703) for decoding the core parameters into a set of core signal; a predominant sound ambiance switch (704) for assigning the decoded core signal to predominant sound and ambiance according to the channel assignment parameters;

a matrix derivation unit (705) for deriving the predominant sound rendering matrix for current frame predominant sound signal from the predominant sound parameters and the layout of the playback speakers; a windowing and rendering (706) unit for performing windowing and rendering on the current frame predominant sound signal; a windowing and rendering unit (707) for performing windowing and rendering on the previous frame predominant sound signal; an addition unit (708) for adding the previous frame rendered predominant sound and current frame predominant sound to form the rendered predominant sound; a matrix derivation unit (709) for deriving the ambiance rendering matrix from the ambiance parameters and the layout of the playback speakers; a ambiance renderer (710) for rendering of the ambiance to playback signals using the rendering matrix; a output signal composition unit (711) for composing the playback signals using the rendered predominant sound and ambient sound;

Suppose that in embodiment 2, windowing cannot be applied to the decoded predominant sound signal, because the predominant sound signals in previous frame and current frame have different spatial directions, the windowing has to be applied to the reconstructed HOA coefficients.

Equation (20) would be revised as:

$$\begin{aligned} W_{PS}(k) &= D(win_{cur}C'(k) + win_{pre}C'(k-1)) \\ &= D(win_{cur}M_{cur}^{-1}C'_{PS}(k) + win_{pre}M_{pre}^{-1}C'_{PS}(k-1)) \\ &= (DM_{cur}^{-1})(win_{cur}C'_{PS}(k)) + (DM_{pre}^{-1})(win_{pre}C'_{PS}(k-1)) \\ &= D'_{cur}C''_{PS}(k) + D'_{pre}C''_{PS}(k-1) \end{aligned} \quad (27)$$

where $C'_{PS}(k)$ denotes the decoded predominant sound signal for current frame $C'_{PS}(k-1)$ denotes the decoded predominant sound signal for previous frame $C''_{PS}(k)$ denotes the windowed predominant sound signal for current frame $C''_{PS}(k-1)$ denotes the windowed predominant sound signal for previous frame $win_{cur}$ denotes the windowing function for current frame $win_{pre}$ denotes the windowing function for previous frame $W_{PS}(k)$ denotes the loudspeaker signals from predominant sound $D'_{cur}$ denotes the new rendering matrix for current frame $D'_{pre}$ denotes the new rendering matrix for previous frame C'(k) denotes the reconstructed audio signal for current frame C'(k−1) denotes the reconstructed audio signal for previous frame D denotes the rendering matrix $M_{cur}$ denotes the transformation matrix for current frame $M_{pre}$ denotes the transformation matrix for previous frame As shown in FIG. 7A, the windowing and rendering is firstly done on current frame decoded predominant sound signal and previous frame decoded predominant sound signal separately (706 and 707), then the previous frame rendered signal and current frame rendered signal is added together to form the final predominant sound output (708).

For the PS windowing & rendering (707) for the previous frame predominant sound, the previous frame PS matrix can be retrieved from previous frame calculation if it is available/stored, if it is not available/stored, the PS rendering matrix can be computed following the same way as (705) but using previous frame spatial parameters and speaker layout information.

Figure 7B:
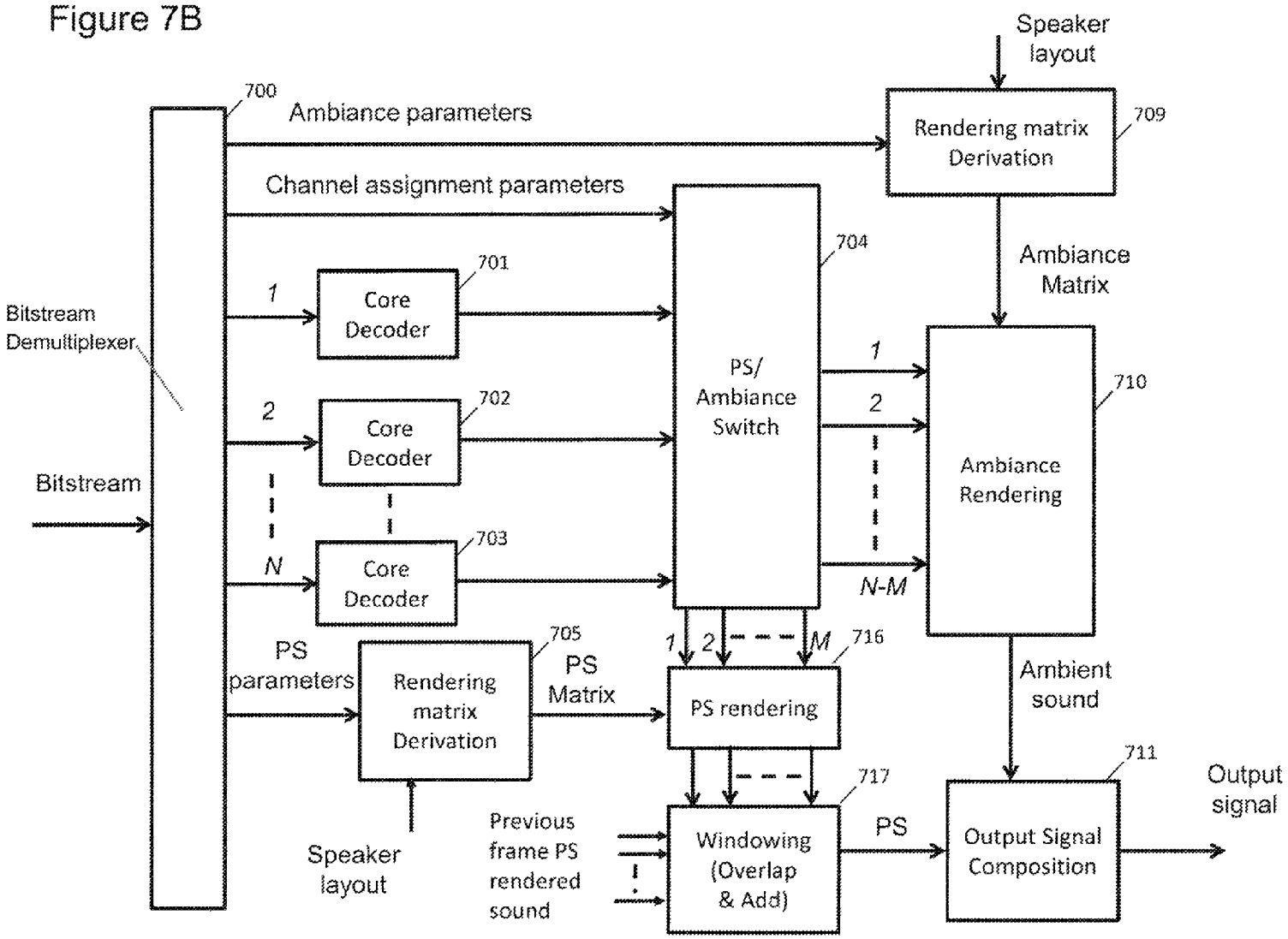
FIG. 7B is another decoder diagram of embodiment 6 in this invention.

Another method is shown in FIG. 7B, the rendering is firstly done on current frame decoded predominant sound signal (716), then the windowing is done on the previous frame rendered signal and current frame rendered signal, finally the windowed previous frame rendered signal and current frame rendered signal is added together to form the final predominant sound output (717).

Effect: In this embodiment, windowing is applied to ensure a continuous and smooth evolution of the sound field across the frame boundaries.

7. Seventh Embodiment

The invented surround sound decoder comprises: a Bitstream De-multiplexer for unpacking a bitstream into rendering flag, predominant sound parameters, ambiance parameters, channel assignment parameters and core parameters; a set of Core Decoder for decoding the core parameters into a set of core signal; a predominant sound ambiance switch for assigning the decoded core signal to predominant sound and ambiance according to the channel assignment parameters; a matrix derivation unit for deriving the predominant sound rendering matrix from the predominant sound parameters and the layout of the playback speakers utilizing the computation method specified by the rendering flag; a matrix derivation unit for deriving the ambiance rendering matrix from the ambiance parameters and the layout of the playback speakers; a predominant sound renderer for rendering of the predominant sound to playback signals using the rendering matrix; a ambiance renderer for rendering of the ambiance to playback signals using the rendering matrix; a output signal composition unit for composing the playback signals using the rendered predominant sound and ambient sound;

In this embodiment, in the bitstream, there is a rendering flag to indicate whether some other data exists in the bitstream which makes the invented idea not practical to be implemented.

Figure 8:
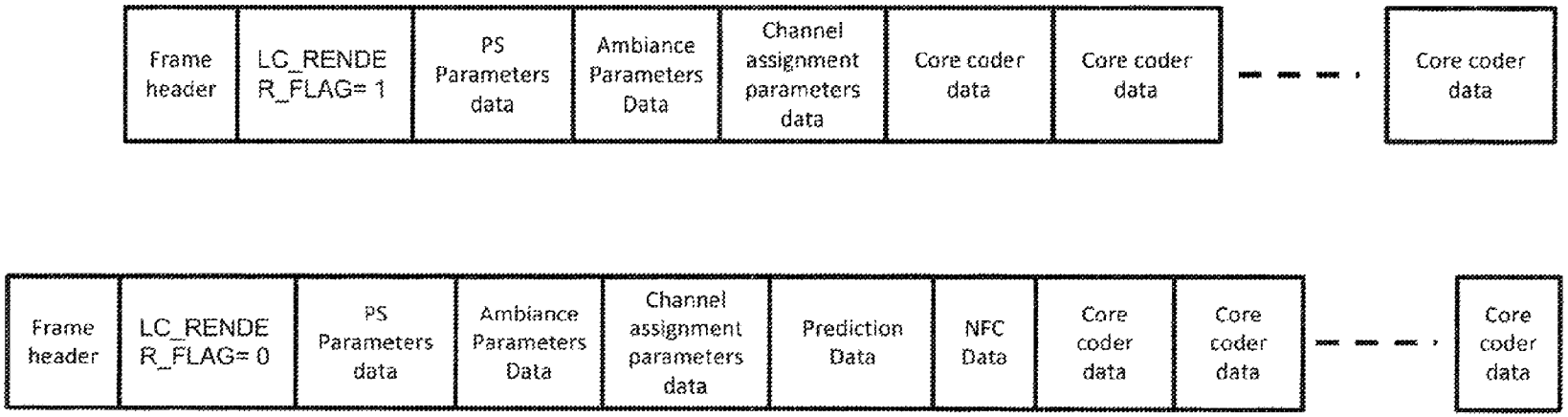
FIG. 8 shows an example of bitstream in embodiment 7 in this invention.

FIG. 8 shows one bitstream as example.

In the bitstream, when there is only PS parameter data, ambiance parameter data, channel assignment parameters data, and core coder data, it is recommended to use the invented idea to achieve low complexity composition and rendering, therefore the rendering flag LC_RENDER_FLAG is set to 1.

In the bitstream, when there is prediction data and near field compensation data, which make it not practical to use the invented idea, it is recommended to use the conventional decoding, composition and rendering tools, therefore the rendering flag LC_RENDER_FLAG is set to 0.

Figure 9:
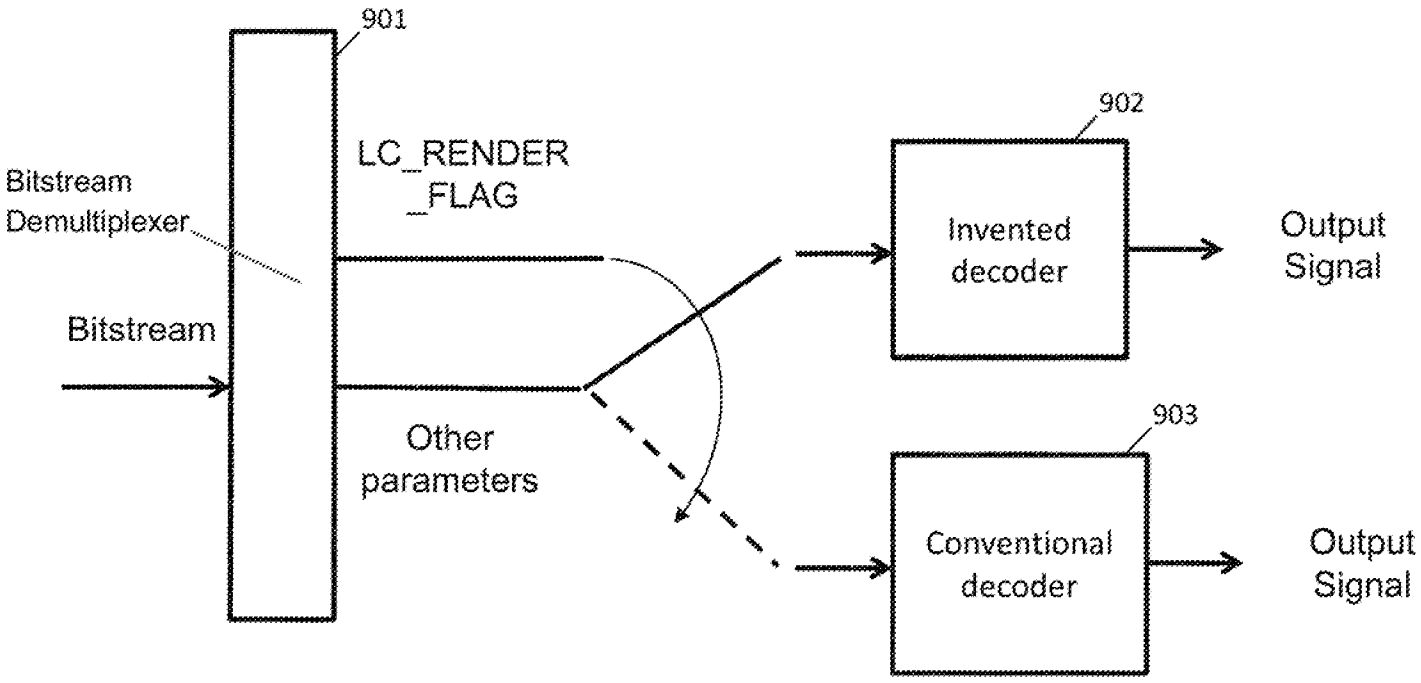
FIG. 9 is a decoder diagram of embodiment 7 in this invention.

FIG. 9 illustrates the afore-mentioned decoder of this embodiment.

The bitstream de-multiplexer (901) unpacks the bitstream into LC_RENDER_FLAG and other parameters;

If LC_RENDER_FLAG is equal to 1, the invented decoder (902) is selected to perform decoding, composition and rendering to achieve low complexity solution.

If LC_RENDER_FLAG is equal to 0, the conventional decoder (903) is selected to perform decoding, composition and rendering.

Effect: In this embodiment, the incompatibility problem of bitstream is solved.

8. Eighth Embodiment

In this embodiment, the encoder comprises a spatial encoder which analyses the input signal and encodes the input signal into the spatial parameters and the N generated signals; a set of core encoders which encode the N generated signals into a set of core parameters; a bitstream multiplexer which packs the spatial parameters and core parameters into a bitstream.

The invented surround sound decoder comprises a bitstream De-multiplexer for unpacking a bitstream into spatial parameters and core parameters; a set of Core Decoder for decoding the core parameters into a set of core signal; a matrix derivation unit for deriving the rendering matrix from the spatial parameters and the layout of the playback speakers; a renderer for rendering of the decoded core signal to playback signals using the rendering matrix.

Figure 10:
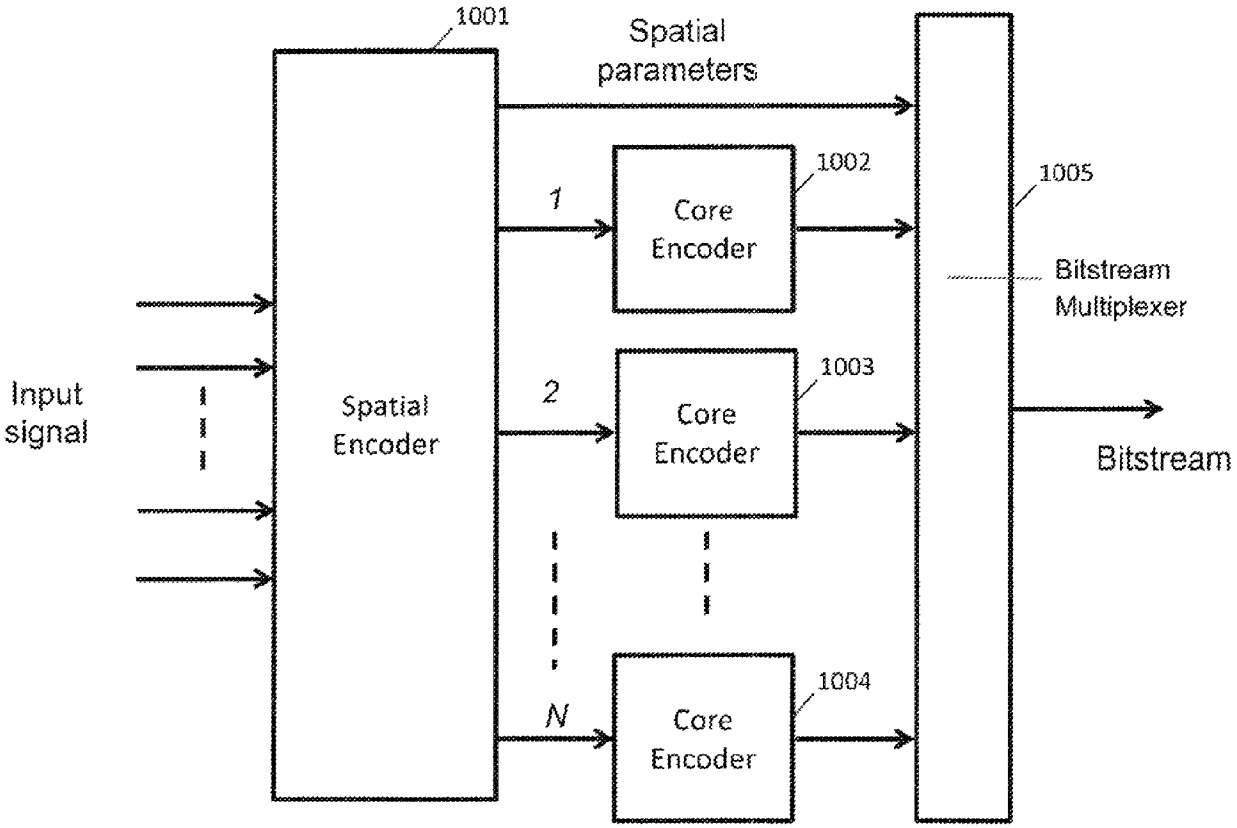
FIG. 10 is an encoder diagram of embodiment 8 in this invention.

FIG. 10 illustrates the afore-mentioned encoder of this embodiment.

The spatial encoder (1001) analyses the input signal and encodes the input signal into the spatial parameters and the N generated signals.

The spatial encoding may be based the analysis of the audio scene, to decide how many sound sources or audio objects in the input audio scene, so as to determine how to extract and encode the sound sources or audio objects. As example, it may be determined that Principal Component Analysis (PCA) is used to extract the sound sources or audio objects and N sound sources are extracted and encoded. During this process, the PCA parameters and the N audio signals are derived. The PCA parameters and N generated audio signals are encoded and transmitted to decoder side.

The generated signal may be derived according to the following equation:

$$S(k)=MC(k) \tag{28}$$

where

C(k) denotes the input audio signal

S(k) denotes the generated audio signal

M denotes the transformation matrix

The set of core encoders (1002, 1003, and 1004) encode the N generated signals into a set of core parameters, the encoder can be any existing or new audio codec such as: MPEG-1 Audio Layer III or AAC or HE-AAC or Dolby AC-3 or MPEG USAC standard.

The bitstream multiplexer (1005) packs the spatial parameters and core parameters into a bitstream.

The corresponding decoder can be the decoder illustrated in FIG. 2.

9. Ninth Embodiment

In the ninth embodiment of this invention, the encoder comprises a audio scene analysis and spatial encoder which analyses the input signal and encodes the input signal into a number of predominant sound and a number of ambiance sound, and also the corresponding predominant sound parameters and ambiance parameters; a channel assignment unit which assigns the core encoders to encode the predominant sound and ambiance sound; a set of core encoders which encode the N channel audio signals, including both the predominant sound and ambiance sound into a set of core parameters; a bitstream multiplexer which packs the predominant sound parameters, ambiance parameters, channel assignment information and core parameters into a bitstream.

Figure 11:
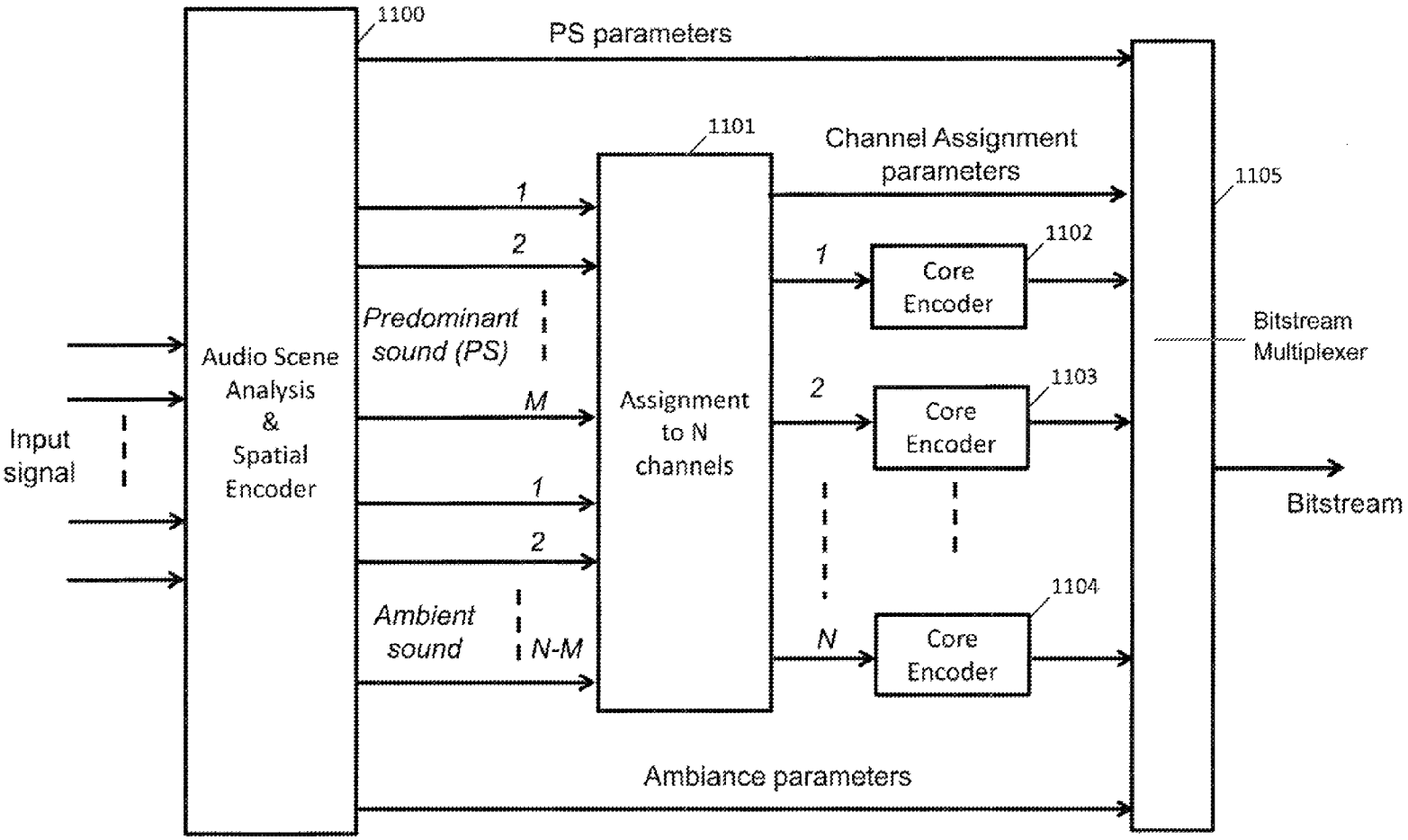
FIG. 11 is an encoder diagram of embodiment 9 in this invention.

The invented surround sound decoder comprises a bitstream de-multiplexer for unpacking a bitstream into predominant sound parameters, ambiance parameters, channel assignment parameters and core parameters; a set of Core Decoder for decoding the core parameters into a set of core signal; a predominant sound ambiance switch for assigning the decoded core signal to predominant sound and ambiance according to the channel assignment parameters; a matrix derivation unit for deriving the predominant sound rendering matrix from the predominant sound parameters and the layout of the playback speakers; a matrix derivation unit for deriving the ambiance rendering matrix from the ambiance parameters and the layout of the playback speakers; a predominant sound renderer for rendering of the predominant sound to playback signals using the rendering matrix; a ambiance renderer for rendering of the ambiance to playback signals using the rendering matrix; a output signal composition unit for composing the playback signals using the rendered predominant sound and ambient sound;

FIG. 11 illustrates the afore-mentioned encoder of the second embodiment.

the encoder comprises a audio scene analysis and spatial encoder which analyses the input signal and encodes the input signal into a number of predominant sound and a number of ambiance sound, and also the corresponding predominant sound parameters and ambiance parameters; a channel assignment unit which assigns the core encoders to encode the predominant sound and ambiance sound; a set of core encoders which encode the N channel audio signals, including both the predominant sound and ambiance sound into a set of core parameters; a bitstream multiplexer which packs the predominant sound parameters, ambiance parameters, channel assignment information and core parameters into a bitstream.

The audio scene analysis and spatial encoder (1101) analyses the input signal and encodes the input signal into a number of predominant sound and a number of ambiance sound, and also the corresponding predominant sound parameters and ambiance parameters.

The audio scene analysis and spatial encoding conducts the analysis of the audio scene, to decide how many sound sources or audio objects in the input audio scene, so as to determine how to extract and encode the sound sources or audio objects. As example, it may be determined that Principal Component Analysis (PCA) is used to extract the sound sources or audio objects and M sound sources are extracted and encoded. During this process, the PCA parameters and the M predominant sound signals are derived. The PCA parameters and M predominant audio signals are encoded and transmitted to decoder side.

The generated signal may be derived according to the following equation:

$$C_{PS}(k)=MC(k) \tag{29}$$

where

C(k) denotes the input audio signal $C_{PS}$(k) denotes the generated audio signal M denotes the transformation matrix The audio scene analysis and spatial encoder may determine that the residual between the input signal and the synthesis signal from predominant sound signal, which may be named as the ambient signal, should also be extracted and encoded. The spatial encode extracts the ambient signal from the difference between the input signal and the synthesis signal from predominant sound signal. The synthesis of the predominant sound may be done according to the equation below:

$$C'(k)=M^{-1}C_{PS}(k) \tag{30}$$

where

C'(k) denotes the reconstructed audio signal from the predominant sound $C_{PS}$(k) denotes the decoded predominant sound signal M denotes the transformation matrix The ambient signal may be derived according to the equation below:

$$C_{AMB}(k)=C(k)-C'(k) \tag{31}$$

where

C'(k) denotes the reconstructed audio signal from the predominant sound

C(k) denotes the input audio signal $C_{AMB}$(k) denotes the ambient signal

Among all the ambient signals, it was determined which of the ambient signals should be encoded. The ambient signals may be processed or transformed to other formats, so that they can be more efficiently encoded.

The channel assignment unit (1101) assigns the core encoders to encode the predominant sound and ambiance sound The information about the choice of the ambient HOA coefficient sequences to be transmitted, about their assignment and about the assignment of the predominant sound signals to the given N channels are transmitted to the decoder side.

The set of core encoders (1102, 1103, and 1104) encode the M predominant sound signals and (N−M) ambient signals into a set of core parameters, the encoder can be any existing or new audio codec such as: MPEG-1 Audio Layer III or AAC or HE-AAC or Dolby AC-3 or MPEG USAC standard.

The bitstream multiplexer (1105) packs the predominant sound parameters, ambiance parameters, channel assignment information and core parameters into a bitstream.

The corresponding decoder can be the decoder illustrated in FIG. 3.

10. Tenth Embodiment

Figure 12:
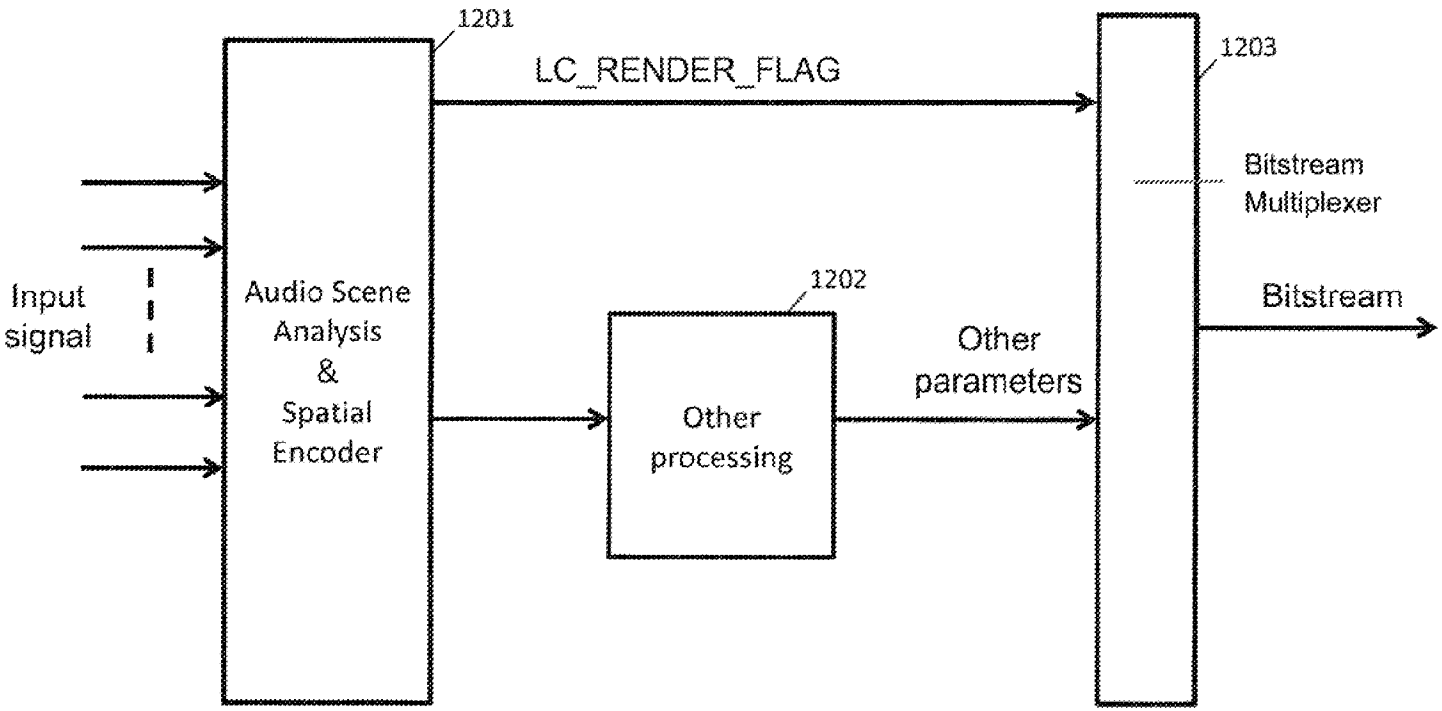
FIG. 12 is an encoder diagram of embodiment 10 in this invention.

FIG. 12 illustrates the afore-mentioned encoder of this embodiment.

The audio scene analysis and spatial encoder (1201) analyses the input signal and encodes the input signal.

The audio scene analysis and spatial encoding conducts the analysis of the audio scene, to decide whether the generated parameters are compatible with the invented idea, and reflect the decision by transmitting the LC_RENDER_FLAG.

If all the generated parameters such as PS parameter data, ambiance parameter data, channel assignment parameters data, and core coder data are compatible with the invented idea, it is recommended to use the invented idea to achieve low complexity composition and rendering in the decoder side, therefore the rendering flag LC_RENDER_FLAG is set to 1.

If not all the generated parameters are compatible with the invented idea, such as there are prediction data and near field compensation data, which make it not practical to use the invented idea in the decoder side, it is recommended to use the conventional decoding, composition and rendering tools, therefore the rendering flag LC_RENDER_FLAG is set to 0.

Effect: In this embodiment, the incompatibility problem of bitstream is solved.

REFERENCES

[1] ISO/IEC JTC1/SC29/WG11/N13411 "Call for Proposals for 3D Audio"

[2] ISO/IEC JTC1/SC29/WG11/N14264 "WD1-HOA Text of MPEG-H 3D Audio"

[3] V. Pulkki, "Virtual Sound Source Positioning Using Vector Base Amplitude Panning," J. Audio Eng. Soc., vol. 45, 1997

[4] T. Lossius, P. Baltazar, and T. d. l. Hogue, "DBAP—Distancebased amplitude panning," in International Computer Music Conference (ICMC). Montreal, 2009.

The invention claimed is:

1. An apparatus for decoding a surround audio signal, comprising:

a Bitstream De-multiplexer for unpacking a bitstream into predominant sound parameters, ambiance parameters, channel assignment parameters and core parameters;

a set of Core Decoders for decoding the core parameters into a set of core signals;

a predominant sound ambiance switch for assigning the decoded core signal to predominant sound and ambiance according to the channel assignment parameters;

a matrix derivation unit for deriving a predominant sound rendering matrix from the predominant sound parameters and playback speaker layout information;

a matrix derivation unit for deriving an ambiance rendering matrix from the ambiance parameters and playback speaker layout information;

a predominant sound renderer for rendering of the predominant sound to playback signals using the predominant sound rendering matrix;

an ambiance renderer for rendering of ambient sound to the playback signals using the ambiance rendering matrix; and an output signal composition unit for composing the playback signals using the rendered predominant sound and the rendered ambient sound.

2. An apparatus according to claim 1, wherein said core decoder corresponds to MPEG-1 Audio Layer III or AAC or HE-AAC or Dolby AC-3 or MPEG USAC standard.

3. An apparatus according to claim 1, wherein said surround audio signal is Higher-Order Ambisonics signal.

4. An apparatus according to claim 1, wherein said spatial parameters comprising of Principal Component Analysis (PCA) or Singular Value Decomposition (SVD) or QR decomposition or Karhunen-Loeve Transform (KLT) parameters.

5. An apparatus according to claim 1, wherein said matrix derivation is done using part of or all of the following parameters: number of target speakers, the speakers' positions, positions of a spherical modelling, HOA order and HOA decomposition parameters.

6. An apparatus according to claim 1 further comprising:

an ambiance synthesis for reconstructing the ambiance signals from the decoded core signal and the ambiance parameters.

7. An apparatus according to claim 6 further comprising:

a predominant sound synthesis for reconstructing the predominant sound signals from the decoded core signal and the predominant sound parameters.

8. An apparatus according to claim 7, wherein said ambiance synthesis includes invert de-correlator for inverse processing of the de-correlation done in the encoder side.

9. An apparatus according to claim 7 further comprising:

an inverse gain control for inverting the gain modifications performed to the signals in the encoder side.

10. An apparatus according to claim 9, wherein said ambiance synthesis includes invert de-correlator for inverse of the de-correlation done in the encoder side.

11. An apparatus according to claim 1 further comprising:

a windowing unit for performing windowing on the previous frame and current frame predominant sound signal; and an addition unit for adding the windowed previous frame predominant sound signal and windowed current frame predominant sound signal to derive the smoothed predominant sound signal.

12. Apparatus according to claim 1 further comprising:

a windowing unit for performing windowing on the previous frame and current frame predominant sound signal, wherein said matrix derivation unit derives the predominant sound rendering matrix for current frame predominant sound signal from the predominant sound parameters and the playback speaker layout information, said predominant sound renderer renders windowed previous frame predominant sound signal and windowed current frame predominant sound signal to playback signals using the predominant sound rendering matrix; and said output signal composition unit composes the playback signals using the rendered previous frame predominant sound, current frame predominant sound and ambient sound.

13. An apparatus according to claim 1, further comprising:

a windowing unit for performing windowing on the previous frame and current frame predominant sound signal, wherein said matrix derivation unit derives the predominant sound rendering matrix for current frame predominant sound signal from the predominant sound parameters and the playback speaker layout information;

said matrix derivation unit derives the predominant sound rendering matrix for previous frame predominant sound signal from the previous frame predominant sound parameters and the playback speaker layout information;

said predominant sound renderer renders windowed previous frame predominant sound signal and windowed current frame predominant sound signal to playback signals using the corresponding rendering matrix; and said output signal composition unit composes the playback signals using the rendered previous frame predominant sound, current frame predominant sound and ambient sound.

14. An apparatus according to claim 1 further comprising a windowing unit for performing windowing on the previous frame and current frame playback signal generated from predominant sound signal; and an addition unit for adding the previous frame playback signal and current frame playback signal generated from predominant sound to form the final rendered predominant sound, wherein said matrix derivation unit derives the predominant sound rendering matrix for current frame predominant sound signal from the predominant sound parameters and the playback speaker layout information.

15. An apparatus according to claim 1, wherein said Bitstream De-multiplexer unpacks a bitstream into rendering flag, and said matrix derivation unit derives the ambiance rendering matrix from the ambiance parameters and the layout of the playback speakers.

16. An apparatus for encoding surround audio signal, comprising:

an audio scene analysis and spatial encoder which analyses the input signal and encodes the input signal into a number of predominant sound and a number of ambiance sound, and also the corresponding predominant sound parameters and ambiance parameters;

a channel assignment unit which assigns the core encoders to encode the predominant sound and ambiance sound;

a rendering flag determination unit which determines a rendering flag to indicate the rendering method to be used in decoder side;

a set of core encoders which encode the generated audio signals, including both the predominant sound and ambiance sound into a set of core parameters; and a bitstream multiplexer which packs the rendering flag, predominant sound parameters, ambiance parameters, channel assignment information and core parameters into a bitstream.

17. A method for decoding surround audio signal, comprising the steps of:

unpacking a bitstream into predominant sound parameters, ambiance parameters, channel assignment parameters and core parameters;

decoding the core parameters into a set of core signals;

assigning the decoded core signal to predominant sound and ambiance according to the channel assignment parameters;

deriving a predominant sound rendering matrix from the predominant sound parameters and playback speaker layout information;

deriving an ambiance rendering matrix from the ambiance parameters and playback speaker layout information;

rendering the predominant sound to playback signals using the predominant sound rendering matrix;

rendering the ambient sound to the playback signals using the ambiance rendering matrix; and composing the playback signals using the rendered predominant sound and the rendered ambient sound.

* * * * *